United States Patent [19]

Gryschuk

[11] 3,970,310

[45] July 20, 1976

[54] ELECTRICAL TARGETS IRREGULARLY ILLUMINATED

[75] Inventor: Danny Gryschuk, Rexdale, Canada

[73] Assignee: Lawrence Peska Associates, Inc., New York, N.Y. ; a part interest

[22] Filed: Mar. 19, 1975

[21] Appl. No.: 559,682

[52] U.S. Cl. ..... 273/102.2 R; 273/102.1 C

[51] Int. Cl.[2] ..... A63F 9/02

[58] Field of Search ..... 35/25, 1 B; 273/105.1, 273/105.2, 102.1 C, 101.1, 101.2, 102.2 R, 102.2 A, 1 B; 353/11

[56] References Cited

UNITED STATES PATENTS

| | | | |
|---|---|---|---|
| 1,475,493 | 11/1923 | Kerestes | 273/105.1 |
| 1,523,747 | 1/1925 | Bradley | 273/102.2 R |
| 2,040,228 | 5/1936 | Whiteley | 273/102.2 R |
| 2,247,751 | 7/1941 | Eakins | 273/101.1 |
| 2,527,326 | 10/1950 | New | 273/102.2 R |
| 3,502,334 | 3/1970 | Tippit | 273/105.2 |

*Primary Examiner*—Richard C. Pinkham
*Assistant Examiner*—Marvin Siskind
*Attorney, Agent, or Firm*—Richard E. Nanfeldt

[57] ABSTRACT

Game apparatus which comprises a plurality of targets arrayed in a generally planar display. In an irregular manner the targets are illuminated for a predetermined time. The apparatus records impact on the illuminated targets.

4 Claims, 7 Drawing Figures

ELECTRICAL TARGETS IRREGULARLY ILLUMINATED

BACKGROUND OF THE INVENTION

The invention relates to game apparatus and particularly to game apparatus which provides a target for a player. The prior art includes a number of game apparatus which in general are so simple as not to be challenging or if challenging are extremely expensive. Apparatus of these general types is included in the following U.S. Pat. Nos.: 1,207,411; 2,335,257; 2,527,326; 2,593,117; and 2,665,133. It is a primary object of the invention to provide apparatus which is simple and inexpensive to manufacture and avoids the necessity for use of optics and other complicated apparatus.

Still another object of the invention is to provide apparatus which requires a minimum of preparation to play and which also is challenging to the player.

SUMMARY OF THE INVENTION

It has now been found that these and other objects of the invention may be attained by game apparatus which comprises a plurality of targets arrayed in a generally planar display, means for illuminating selectively individual targets for a predetermined time interval, and if there is no impact of an article upon the target during the predetermined time on the illuminated target, means for keeping the target illuminated for a second predetermined time interval, and means for sounding an alarm if a hit within an associated sponge is made on the illuminated target.

BRIEF DESCRIPTION OF THE DRAWING

The invention will be better understood by reference to the accompanying drawing in which.

DESCRIPTION OF THE PREFERRED EMBODIMENT

Figure 1:
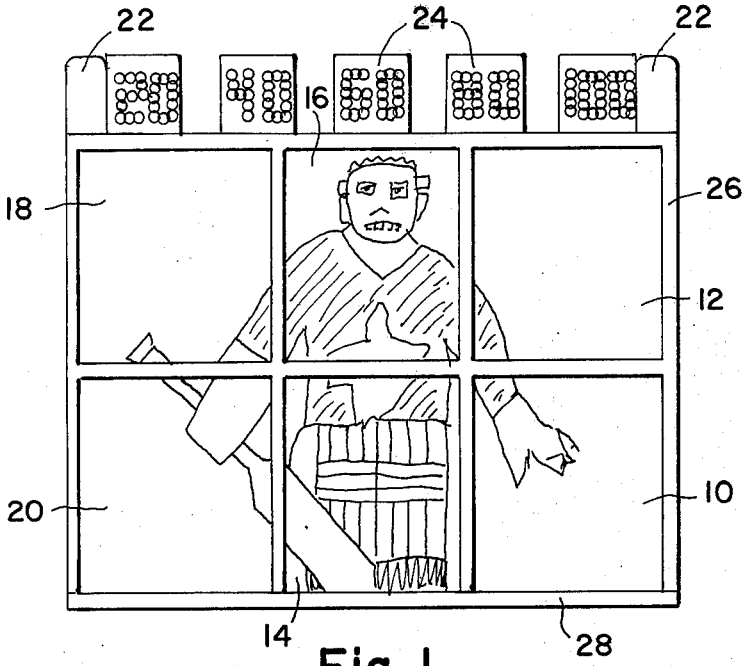
FIG. 1 is a front elevational view of the apparatus in accordance with the invention.
Figure 2:
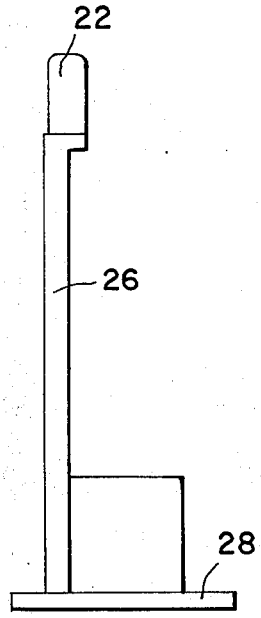
FIG. 2 is a side elevational view of the apparatus shown in FIG. 1.
Figure 3:
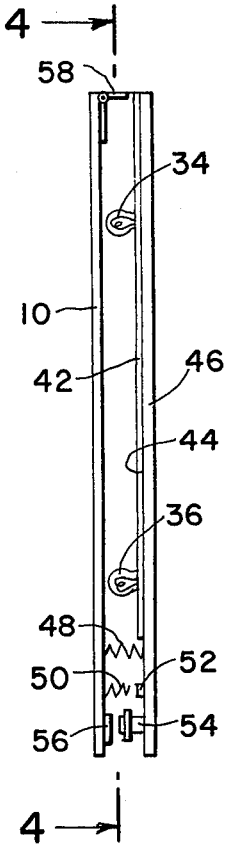
FIG. 3 is a side elevational view of a portion of the apparatus shown in FIG. 1.
Figure 4:
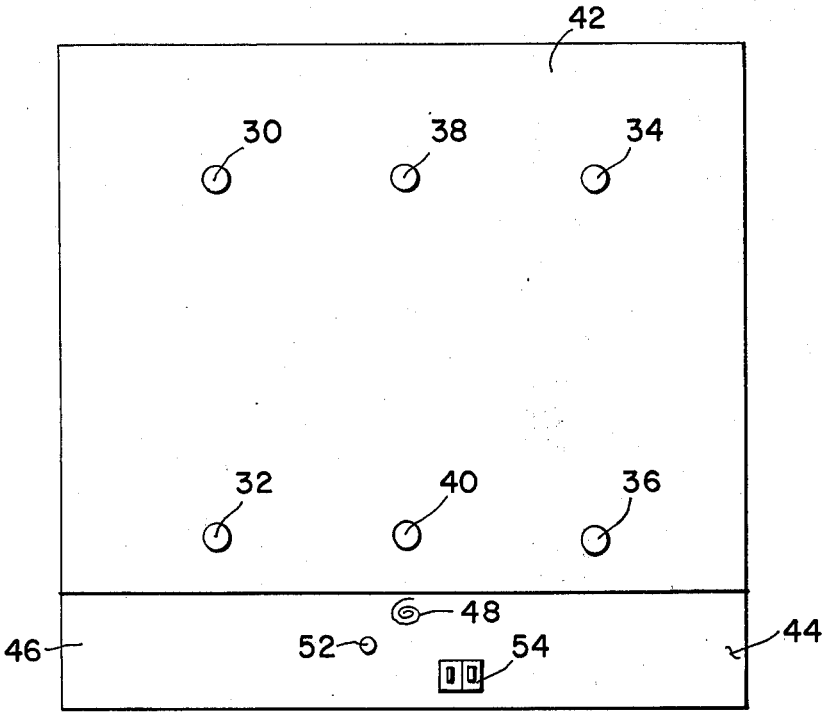
FIG. 4 is a sectional view taken through the line 4—4 of FIG. 3.

The invention will be better understood by a brief description of the manner of play therewith together with a description of the mechanism shown in FIGS. 1 through 4. A player faces the picture of a goalee which in the preferred form is approximately 3 feet by 4 feet. The goalee picture is divided into six different targets or sections identified respectively by the numbers 10, 12, 14, 16, 18 and 20. Normally the player will stand approximately 20 to 25 feet away from the game. During play one of the six panels 10 through 20 will be illuminated for a one and one half second interval. The player will then have an opportunity to take a single shot with an associated sponge or puck in an attempt to hit the lighted panel. If the player misses the panel the light will go off after one and one half seconds. Thereafter, there will be a pause for another half of a second. Then a different panel will light up again for one and one half seconds. This cycle repeats itself until a hit is made. A hit is made when the player hits the panel that is lit at the time before the one and a half second time period is expired. However, when the hit is scored, a red goal light 22 is illuminated, a buzzer 23 goes off and one of the score lights 24 goes on for one half of one second. In other words this means that if it took one second for a player to hit the panel the score lights 24 would stay on for the remaining one half of a second which would be ample time for him to know the score.

The game ordinarily utilizes five sponge pucks (not shown) to use by each player who will have the opportunity to throw five shots for five attempts to hit before forfeiting his turn to his opponent or opponents. The object of the game is to reach a score of 500 in order to win. Other alternative game plays may include attempts to hit all six different panels or various other combinations which will be apparent to those playing the game.

It will be seen that the targets 10 through 20 are held in place by means of a frame 26 which is supported by a base 28. Panel or tire lights 30, 32, 34, 36, 38 and 40 are provided for selective illumination of target panels 10 through 20. Aluminum foil 42 is provided along the inside surface 44 of the back 46 of the frame 26. The function of the aluminum foil 42 is to increase the reflectivity of the light from any of the lights 30–40. A light spring 48 is disposed intermediate the back 46 of the frame and the front panel such as 10. Upon impact with the panel 10 the spring 48 is compressed and electrical contact is made between a spring electrical contact 50 with a stationery contact 52. The contacts 50, 52 are drawn together positively once urged generally together by means of an electromagnet 54 which engages a ferrous plate 56 carried on the panel 10. It will be seen on the panel 10 is carried by a hinge 58 which engages the frame 26.

Figure 5:
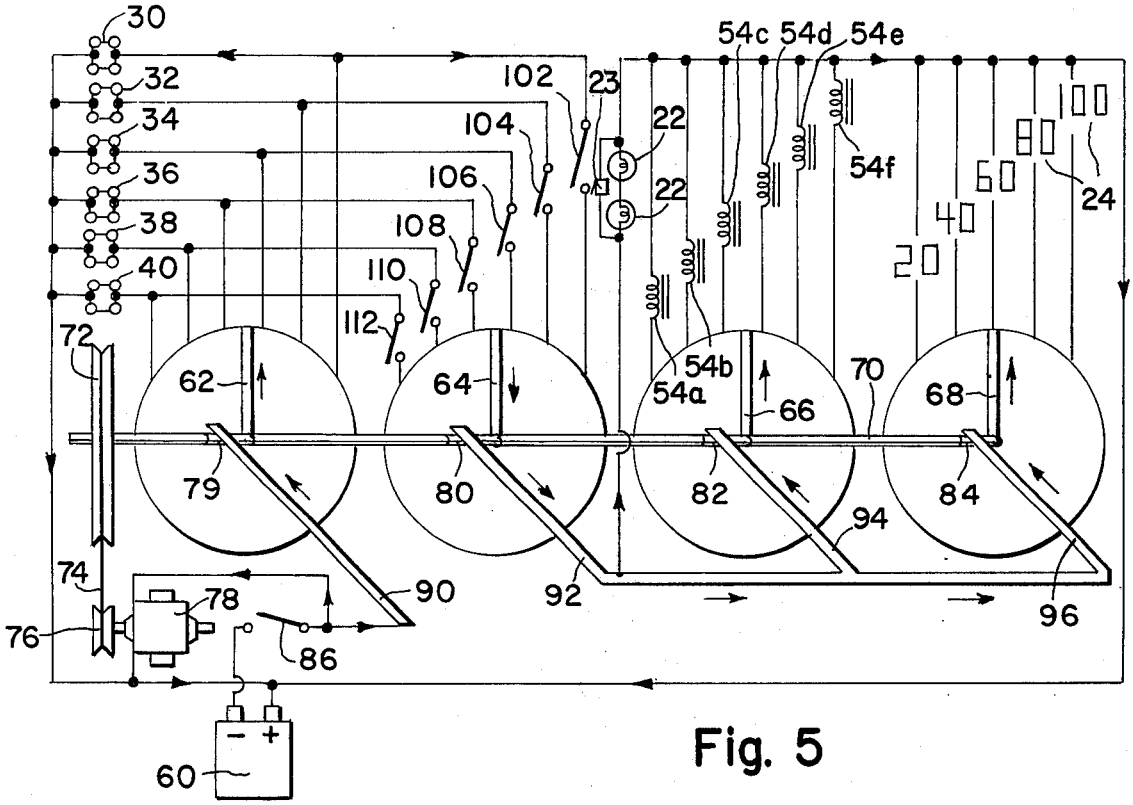
FIG. 5 is a schematic view of the apparatus in accordance with the invention.
Figure 6:
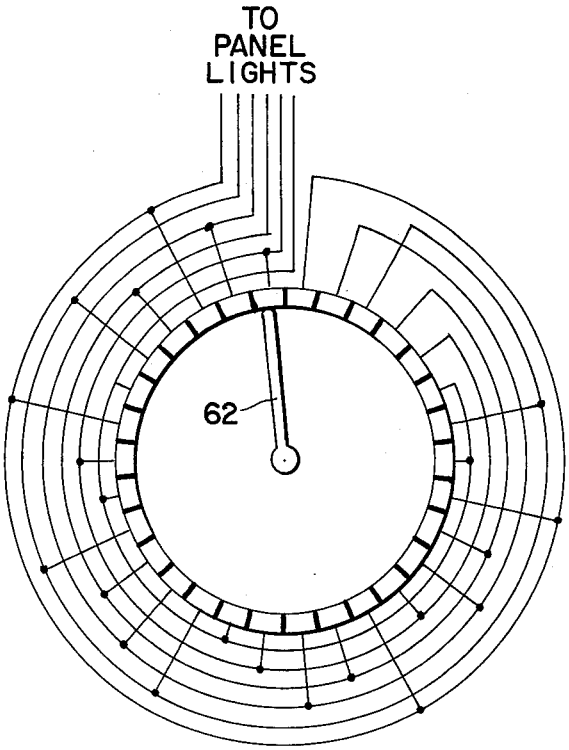
FIG. 6 is an elevational view of a rotary contact wheel in accordance with the invention.
Figure 7:
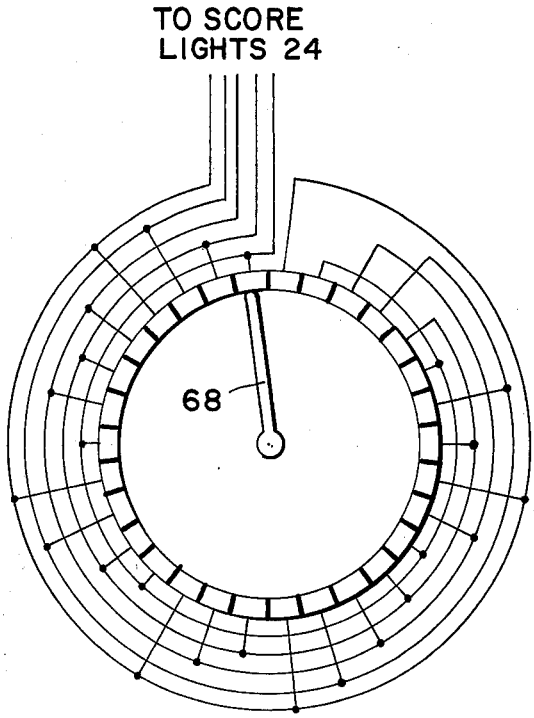
FIG. 7 is a view of another rotary contact wheel similar to that of FIG. 6.

Other aspects of the invention will be seen by referring to FIGS. 5 through 7. In the preferred form of the invention a six or 12 volt battery 60 is provided for powering the apparatus. It will be understood that in other forms of the invention that a convertor from 117 volts AC or whatever power supply is locally available may be utilized. Four contact wheels 62, 64, 66, and 68 are disposed in coaxial relationship on a common axis 70 which is driven by means of a pulley 72, belt 74 and pulley 76 carried on a motor 78. Each contact wheel 62–68 is provided with 30 separate contact points. The axis or rod 70 is provided with four discrete rotor contacts 79, 80, 82, and 84 which are in electrical contact respectively with the rotor wheels 62, 64, 66 and 68 respectively. Each rotor contact is isolated from every other rotor contact by an axial section of nonconductive material. The motor 78 will normally be of a high impedance type and the pulleys 76, 72 provide normally a ratio therebetween of 200 to 1 respectively. When the power switch 86 is turned on the motor 78 will turn causing the rod to rotate together with the contact wheels and rotor contacts or commutator strips 79, 80, 82 and 84. Brushes 90, 92, 94 and 96 respectively make contact with commutator strips 79, 80, 82 and 84. It will be seen rotation of contact wheels causes selective illumination of the bulbs 30–40 if when any one panel light 38, 40 is on as a result of the closing of a switch 102, 104, 106, 108, 110, 112 associate therewith being closed and a hit is scored causing the compression of spring 48 and the contact between contacts 50, 52 then the goal lights 22 will be illuminated and buzzer 23 will sound. The contact wheel 66 provides circuitry for supplying power to each of the 54*a* through 54*f* to hold the switch 52 closed by supplying power through wheel 66. It will be seen that the goal lights 22, buzzer 23, electromagnetic catches 54*a* through 54*f* are connected in parallel. The panel lights 30–40 and the score lights 24 may be set up in series such that each different score (20–100) can be obtained by each panel.

The construction of the rotor 62 is identical to the rotor 64 and the former is illustrated in greater detail in FIG. 6. Similarly the construction of rotor 66 is identical to rotor 68 which is illustrated in greater detail in FIG. 7.

The panel lights 30–40 and the score lights 24 should be set up in a series such that each different score (20–100) can be obtained by each panel. For example:

| | | | | | | | | | | | | |
|---|---|---|---|---|---|---|---|---|---|---|---|---|
| Contact No. | 1 | 2 | 3 | 4 | 5 | 6 | 7 | 8 | 9 | 10 | 11 | 12 |
| Score | 100 | 20 | 20 | 80 | 20 | 60 | 80 | 80 | 60 | 20 | 60 | 80 |
| Panel | 6 | 2 | 3 | 4 | 1 | 5 | 1 | 3 | 4 | 6 | 2 | 5 |
| Contact No. | 13 | 14 | 15 | 16 | 17 | 18 | 19 | 20 | 21 | 22 | 23 | 24 |
| Score | 100 | 60 | 100 | 60 | 40 | 40 | 40 | 40 | 80 | 25 | 100 | 100 |
| Panel | 5 | 6 | 4 | 1 | 2 | 3 | 1 | 4 | 6 | | 3 | 2 |
| Contact No. | 25 | 26 | 27 | 28 | 29 | 30 | | | | | | |
| Score | 80 | 20 | 40 | 40 | 100 | 80 | | | | | | |
| Panel | 3 | 4 | 5 | 6 | 1 | 2 | | | | | | |

It will be understood that the contact members referred to herein relate to successive circumferencially disposed contacts on the rotor.

Having thus described my invention, I claim:

1. Game apparatus, which comprises:

a. a base;

b. a frame extending upwardly from said base, said frame having a back;

c. a plurality of front panels held in place by said frame;

d. a plurality of light means affixed to said frame for illumination of said panels;

e. one light spring disposed intermediate said back of said frame and each said front panel;

f. a ferrous plate affixed to an inside surface of each said front panel;

g. a plurality of electromagnets affixed to an inside surface of said back of said frame, one said ferrous plate aligned with each said electromagnet;

h. a plurality of stationery electrical contacts affixed to said inside surface of said back of said frame;

i. a spring electrical contact affixed to said inside of each said panel, each said spring contact aligned with one said stationery contact;

j. a battery means for powering said apparatus;

k. four contact wheels disposed in coaxial relationship on a common rod driven by means of a first pulley, belt, and a second pulley carried on a motor, each said contact wheel having separate contact points, said rod having four discrete rotor contacts, said rotor contacts in electrical contact respectively with said rotor wheels;

l. a plurality of brushes, each said brush respectively making contact with one said rotor contact causing selective illumination of one said light means upon rotation of one said contact wheel causing a closing of one of a plurality of switch means;

m. a goal light;

n. a buzzer, said goal light and said buzzer activated upon electrical contact between said stationery and said spring contacts;

o. each said contact wheel providing power to each said electromagnet holding stationery contact closed by supplying power through each said contact wheel, each said goal light, said buzzer and electromagnet wired in parallel;

p. a plurality of score lights wired in series to each said light means;

q. a plurality of sponge members, one said sponge member hitting one said panel at a time causing movement of said panel thereby causing electrical contact between one said stationery and one said spring electrical contact.

2. A game apparatus according to claim 1, wherein said front panels are six in number.

3. A game apparatus according to claim 1, wherein each said panel is affixed to said frame by a hinge means.

4. A game apparatus according to claim 1, wherein aluminum foil is provided along said inside surface of said back of said frame for increasing the reflectivity of each said light means.

* * * * *